US005325673A

United States Patent [19]

Durr et al.

[11] Patent Number: 5,325,673

[45] Date of Patent: Jul. 5, 1994

[54] NATURAL GAS LIQUEFACTION PRETREATMENT PROCESS

[75] Inventors: Charles A. Durr, Houston; WIlliam C. Petterson, Missouri City, both of Tex.

[73] Assignee: The M. W. Kellogg Company, Houston, Tex.

[21] Appl. No.: 21,384

[22] Filed: Feb. 23, 1993

[51] Int. Cl.[5] ..... F25J 3/06

[52] U.S. Cl. ..... 62/23; 62/17; 62/20; 62/25

[58] Field of Search ..... 62/17, 20, 23, 25, 26

[56] References Cited

U.S. PATENT DOCUMENTS

| | | | |
|---|---|---|---|
| 3,440,828 | 4/1969 | Pryor et al. | 62/27 |
| 3,702,541 | 11/1972 | Randall et al. | 62/26 |
| 3,724,226 | 4/1973 | Pachaly | 62/39 |
| 3,817,046 | 6/1974 | Aoki et al. | 62/40 |
| 3,932,156 | 1/1976 | Stern | 62/17 |
| 4,012,212 | 3/1977 | Kniel | 62/28 |
| 4,022,597 | 5/1977 | Bacon | 62/28 |
| 4,070,165 | 1/1978 | Colton | 55/30 |
| 4,430,103 | 2/1984 | Gray et al. | 62/28 |
| 4,445,916 | 5/1984 | Newton | 62/17 |
| 4,445,917 | 5/1984 | Chiu | 62/25 |
| 4,451,274 | 5/1984 | O'Brien | 62/17 |
| 4,466,946 | 8/1984 | Goddin, Jr. et al. | 62/17 X |
| 4,519,824 | 5/1985 | Huebel | 62/26 |
| 4,596,588 | 6/1986 | Cook | 62/26 |
| 4,597,788 | 7/1986 | Apffel | 62/26 |
| 4,657,571 | 4/1987 | Gazzi | 62/23 X |
| 4,690,702 | 9/1987 | Paradowski et al. | 62/23 |
| 4,695,672 | 9/1987 | Bunting | 62/20 |
| 4,698,081 | 10/1987 | Aghili | 62/24 |
| 4,705,549 | 11/1987 | Sapper | 62/17 X |
| 4,717,408 | 1/1988 | Hopewell | 62/20 |
| 4,747,858 | 5/1988 | Gottier | 62/17 |
| 4,881,960 | 11/1989 | Ranke et al. | 62/20 |
| 4,935,043 | 6/1990 | Blanc et al. | 62/20 |
| 4,976,849 | 12/1990 | Soldati | 62/23 X |

*Primary Examiner*—Henry A. Bennet
*Assistant Examiner*—Christopher B. Kilner
*Attorney, Agent, or Firm*—John P. Ward

[57] ABSTRACT

A method for pretreating a natural gas stream using a single scrub column to remove freezable $C_{5+}$ components and provide an LNG product which can be conveniently handled and shipped is disclosed. The method comprises feeding a natural gas stream to a feed point on a scrub column operated substantially as an absorption column wherein the heavy components are absorbed from the feed gas using a liquid reflux essentially free of such $C_{5+}$ components. The feed can be vapor introduced at a low point on the column, or can be optionally split, cooled and/or expanded and introduced at one or more feed points on the column. The reflux stream can be overhead vapor condensate having a temperature of about —40° C., or methane-rich LNG or a combination of LNG and vapor condensate.

17 Claims, 3 Drawing Sheets

NATURAL GAS LIQUEFACTION PRETREATMENT PROCESS

FIELD OF THE INVENTION

The present invention relates to process technology for removing freezable hydrocarbon components from natural gas prior to liquefaction.

BACKGROUND OF THE INVENTION

Natural gas is liquefied to facilitate its transportation. Prior to liquefaction, raw natural gas must generally be treated to remove components which can freeze and plug equipment during the formation and/or processing of liquefied natural gas (LNG). Thus, water, carbon dioxide and heavier hydrocarbon components containing 5 or more carbon atoms ($C_{5+}$) are generally removed.

It has typically also been desirable to fractionate natural gas into its various hydrocarbon components. Ethane, propane and butane ($C_2$–$C_4$) are commonly used as refrigerants for natural gas liquefaction in the so-called multicomponent or cascade refrigeration processes. Pentanes and heavier hydrocarbons generally have greater economic value as NGL's (natural gas liquids) for use in chemical feed stocks and gasoline. Fractionation processes typically involve cooling the natural gas to effect a partial condensation and feeding the partially condensed stream to a fractionation column commonly known as a scrub column. Methane is taken primarily in the overhead vapor and heavier components are removed primarily as a bottoms liquid. The bottoms are usually fractionated further into individual $C_2$–$C_4$ components for makeup gas in the LNG refrigeration system (e.g. multicomponent or cascade) and/or in order to make a liquefied petroleum gas (LPG) product. Typically, the scrub column employs either an overhead condensate reflux or a butane wash.

In circumstances where removal of freezable hydrocarbons prior to natural gas liquefaction is the primary requirement, the prior art fails to recognize inefficiencies in scrubbing systems. For example, in liquid natural gas (LNG) plants employing liquid nitrogen as the primary refrigerant, or where $C_2$–$C_4$ refrigerants are already available from other sources, $C_2$–$C_4$ fractionation may be unnecessary. Or, if the feed gas is very lean, fractionation may not be economical. The prior art processes for pretreating natural gas prior to liquefaction are not well-suited for such circumstances, are not energy efficient and incur excessive capital equipment costs.

U.S. Pat. No. 4,012,212 to Kniel describes a process for liquefying a hydrocarbon gas under a pressure greater than the critical pressure thereof wherein the gas is expanded to below the critical pressure and fed to a first fractionator. The first fractionator removes the light components from the feed gas for subsequent liquefaction. The bottoms of the first column are fed to a second fractionator wherein a butane-rich stream is separated from the $C_5$ and heavier hydrocarbons to provide a reflux liquid for the first fractionator.

U.S. Pat. No. 4,070,165 to Colton describes a pretreatment process for raw natural gas prior to liquefaction. After water and acid gas removal, the high pressure gas is expanded and scrubbed with a butane-rich liquid previously separated from the gas to remove heavy hydrocarbons. A scrubbing column separates the lighter components for subsequent liquefaction and the bottoms are fractionated into the major components and the butane-rich liquid.

U.S. Pat. No. to 4,430,103 to Gray et al. describes a process for the cryogenic recovery of LNG from natural gas. A natural gas stream predominating in methane and containing significant amounts of $C_2$, $C_3$, $C_4$, and $C_5$ and higher molecular weight hydrocarbons is cooled in a plurality of cooling stages to a temperature sufficient to produce at least one heavy component liquid phase. In one of the intermediate cooling stages, the liquid phase and a portion of the vapor phase are combined and fed to a column. The remaining portion of the vapor phase is further cooled and the liquid phase of these stages provides a reflux liquid for the column. The bottoms from the column are further fractionated to provide $C_2$ and $C_3$ makeup gas for the cooling stages and separate $C_{5+}$ liquids.

U.S. Pat. No. 4,445,917 to Chiu describes a process for producing a purified natural gas from a raw gas feed containing methane and hydrocarbon impurities of $C_2$ and heavier. The raw feed is cooled, distilled to remove impurities and purified such that the distillation reflux is supplied by a portion of a subcooled methane-rich liquid stream.

U.S. Pat. No. 3,817,046 to Aoki et al. describes a combination cooling system useful for the liquefaction of natural gas. The cooling system employs a multicomponent cooling cycle coupled to an absorption refrigerant cycle and heat from turbine exhaust. A distillation column is used to remove heavy components which can freeze. The vapor phase removed from the column is cooled to provide condensate for reflux and the vapor portion is then liquefied.

U.S. Pat. No. 4,445,916 to Newton describes a process for liquefying natural gas in which heavier components are separated in a scrub column prior to liquefaction. The feed to the scrub column is intercooled against the methane-rich overhead from the column and expanded.

U.S. Pat. No. 3,440,828 to Pryor et al. describes a process for liquefying natural gas using cascade refrigeration. The raw gas is partially cooled using a propane refrigeration cycle and fed to a distillation column to remove hexane. The overhead vapor is cooled using an ethylene refrigeration cycle and a liquid phase produced provides a reflux for the distillation column. The vapor of the ethylene cooling cycle is cooled in a methane cycle then expanded and fed to a stripping column wherein the liquid feed is stripped of nitrogen.

U.S. Pat. No. 3,724,226 to Pachaly describes a process for the liquefaction of natural gas. The raw gas is cryogenically fractionated to remove the $CO_2$ and $C_{5+}$ hydrocarbons and the purified feedstock is cooled and liquefied under pressure. The overhead vapor of the fractionation column is partially condensed to provide a reflux.

U.S. Pat. No. 4,881,960 to Ranke et al. describes a process for scrubbing a hydrocarbon stream rich in $C_{2+}$ with a physical scrubbing agent in a column to remove the $C_{2+}$ components. The scrubbing agent is a $C_{4+}$ bottoms product having a suitable composition.

U.S. Pat. No. 4,519,824 to Huebel describes a cryogenic process for separating methane from ethane and heavier hydrocarbons in which a high pressure gas feed is divided into two gas streams. The gas is cooled either before or after it is divided. The divided gas streams are selectively cooled, expanded and separated into vapor and condensate streams and fed to a fractionation column.

Other U.S. Patents of interest include U.S. Pat. No. 4,022,597 to Bacon; U.S. Pat. No. 3,702,541 to Randall et al.; U.S. Pat. No. 4,698,081 to Aghili; U.S. Pat. No. 4,597,788 to Apffel; and U.S. Pat. No. 4,596,588 to Cook.

SUMMARY OF THE INVENTION

The present invention is based in part on the recognition that in many instances complex natural gas pretreatment schemes prevalent in the prior art are very inefficient. Natural gas can be pretreated to remove freezable hydrocarbons having 5 or more carbon atoms ($C_{5+}$) by employing a single scrub column operated with (1) more of the hydrocarbons having from 2 to 4 carbon atoms ($C_2$–$C_4$) being produced overhead; (2) a feed stream having a vapor-liquid mass ratio of $C_2$–$C_4$ hydrocarbons greater than 1; and/or (3) a reflux comprising liquefied natural gas or overhead vapor condensate. In so doing, separation efficiency for $C_{5+}$ components is substantially enhanced while reducing capital costs and energy requirements.

One aspect of the present invention feeds natural gas essentially free of $CO_2$ and water to a scrub column at a stage preferably near the bottom and employs an overhead vapor condensate reflux. In comparison to the prior art wherein the feed is generally cooled initially, savings are achieved because the present invention condenses less $C_2$–$C_4$ hydrocarbons in the feed to the column, resulting in lower refrigeration and reboiler duties. In addition, an enhanced $C_{5+}$ separation factor permits operation of a scrub column having fewer stages.

The present invention provides a method of pretreating a natural gas stream for liquefaction by removing freezable $C_{5+}$ components. In one step, a natural gas stream is introduced to a first feed point on a scrub column having upper enriching and lower stripping sections, wherein the feed stream contains methane and $C_{5+}$ hydrocarbons. As another step, the feed stream is contacted with a reflux liquid at the upper section of the column to absorb $C_{5+}$ hydrocarbons from the feed stream. An overhead vapor product having a concentration of less than about 1 ppm of hydrocarbons having 6 or more carbon atoms ($C_{6+}$), and a liquid bottoms product enriched in $C_{5+}$ hydrocarbons, are recovered from the column. A portion of liquid in the lower section of the column is reboiled to remove light components from the bottoms product. The column is preferably operated with a molar vapor/liquid mass ratio in the feed of $C_2$–$C_4$ hydrocarbons greater than about 1, i.e., more $C_2$–$C_4$ is vapor than liquid in the scrub column feed.

In one preferred embodiment, natural gas essentially free of water and $CO_2$ is introduced to the scrub column at a relatively low feed point and at an ambient temperature, preferably from about 0° C. to about 30° C. The reflux preferably comprises overhead vapor condensate at a temperature of about ambient down to about −40° C.

In another preferred embodiment, lean natural gas feed, containing less than about 3 mole percent of $C_2$ and heavier hydrocarbons, is cooled to a temperature of from about 0° C. to about −22° C. and is introduced to a scrub column at a midcolumn feed point. The reflux comprises LNG, vapor condensate or a combination thereof. A portion of the feed stream is preferably split into an upper feed stream and fed to the enriching section of the scrub column. The upper feed stream is preferably separated into a liquid feed stream and a vapor feed stream which is expanded. The expanded vapor feed stream is introduced to an enriching section of the column, and the liquid feed stream is introduced to the column at a feed point one or more stages above the midcolumn feed point and below the vapor feed point. When LNG reflux is used, the temperature at the top of the scrub column is controlled between about −75° C. and about −50° C. by adjusting the reflux rate.

These embodiments can be advantageously used in a liquefaction plant operating on a lean natural gas feed (i.e. less than about 3 mole percent $C_{2+}$) or having excess refrigeration availability (e.g. in a liquid nitrogen haulback scheme) wherein LNG can be used for reflux without economic penalty otherwise incurred in a process relying on cascade or multi-component refrigeration. The present invention provides a single column process to produce a natural gas liquids (NGL) product (i.e. $C_{5+}$) which is conveniently stored and shipped.

DETAILED DESCRIPTION OF THE INVENTION

Figure 1:
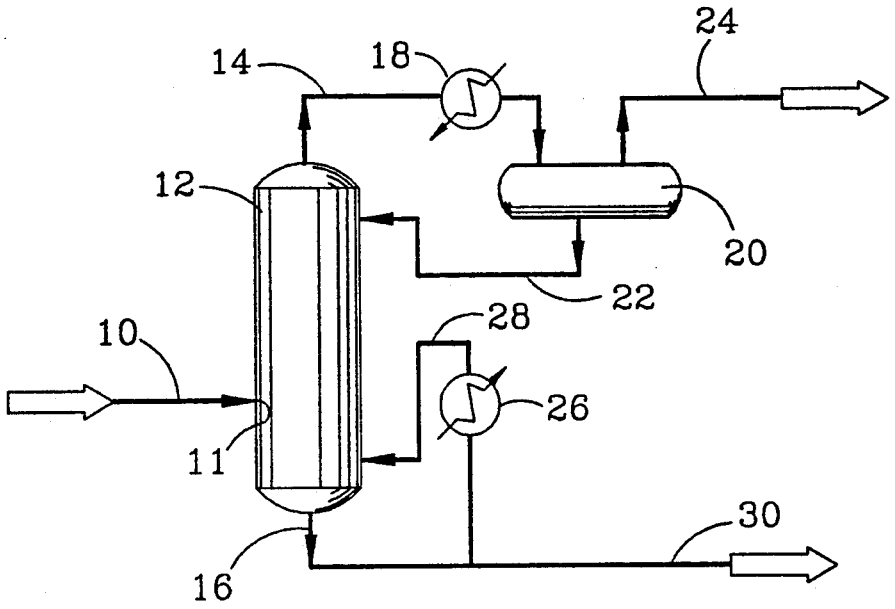
FIG. 1 is a schematic diagram of an embodiment of the present invention showing a scrub column using overhead condensate reflux.

A natural gas scrub column, designed to separate freezable $C_{5+}$ components from natural gas, has reduced refrigeration and reboiler duty as well as greatly enhanced $C_{5+}$ separation efficiency when operated substantially as an absorber. Referring first to FIG. 1, natural gas, previously treated to remove water, $Co_2$ and sulfur by means well known in the art, is introduced through line 10 under pressure to the scrub column 12 preferably as a vapor or at a high mass ratio of vapor to liquid $C_2$–$C_4$ components, e.g., more than 90 to 10. The feed is preferably at a relatively low feed point 11, i.e., there are more stages in the enriching section above the feed point than in the lower stripping section below the feed point, to effect removal of freezable $C_{5+}$ components. The temperature of the natural gas in line 10 has an ordinary ambient temperature on the order of 17° C. The pressure in line 10 generally ranges between about 3.5 MPa (500 psia) to about 14 MPa (2000 psia), and more preferably between about 3.5 MPa to about 7 MPa (1000 psia). It is well known that the operating pressure in the column 12 must be lower than the critical pressure of the gas mixture (the critical pressure of methane is 4.64 MPa (673 psia)) to enable phase separation based on boiling point differences of gas components to take place.

The feed point 11 is selected in conjunction with temperature and composition similarity of the feed gas and a given location in the column 12. The present process is specifically designed to remove freezable $C_{6+}$ components to a relatively low concentration in an overhead vapor product 24. Design of the column 12 in reference to tray count (where appropriate) and diameter conforms to standard practice. The column 12 is substantially operated in an absorption region, i.e., more $C_2$–$C_4$components are obtained in the vapor product 14 than in the bottoms line 16, and substantially all of the $C_{5+}$ components are discharged to the bottoms line 16. Thus, the overhead vapor stream comprising primarily methane and $C_2$–$C_4$ components is taken from the column 12 through line 14. A portion of the overhead vapor is condensed by refrigeration cooler or partial condenser 18 and collected in a separator 20. The condensed overhead stream is returned to the column 12 through line 22 to provide a reflux. The reflux liquid is thus essentially free of $c_{5+}$ and absorbs $C_{5+}$ components from the vapor stream rising in the column 12. If desired, one or more intercondensers (see FIG. 3) can be operated, typically up to three intercondensers spaced between the feed point 11 and the reflux line 22. The overhead partial condenser 18 preferably operates at a temperature less than ambient to about −40° C. Suitable refrigerants include, for example, propane and freon. An overhead vapor product comprising less than about 1 ppm $C_{6+}$ components is removed through line 24 for subsequent liquefaction in an LNG plant.

A bottoms liquid rich in $C_{5+}$ components with a minor amount of $C_2$–$C_4$ components is removed through line 16. A portion of the liquid is vaporized by the reboiler 26 and returned to the column 12 through line 28. A bottoms stream comprising a natural gas liquids (NGL) product is withdrawn through line 30 for distribution.

Figure 2:
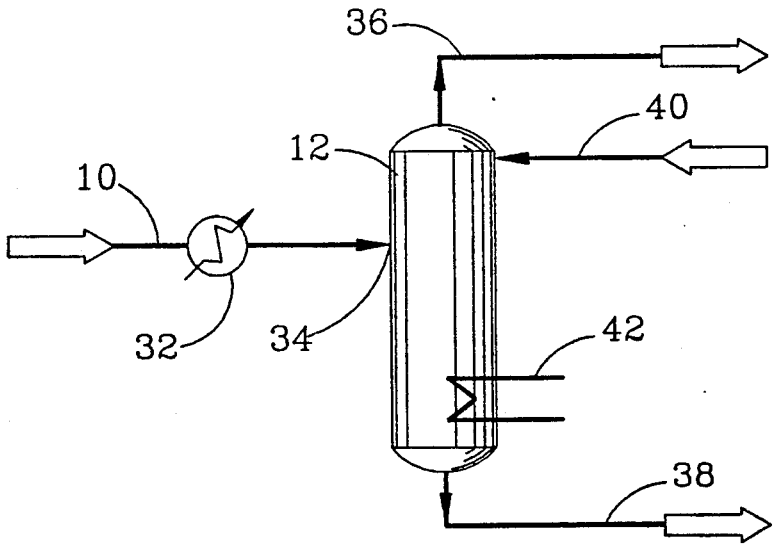
FIG. 2 is a schematic diagram of another embodiment of the present invention showing a scrub column using LNG reflux.
Figure 3:
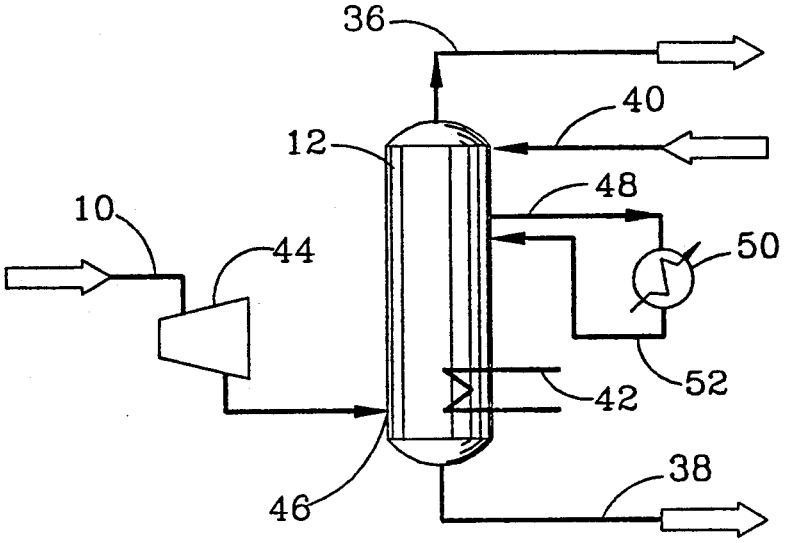
FIG. 3 is a schematic diagram of yet another embodiment of the present invention showing a scrub column using an expanded feed stream and reflux comprising LNG and sidestream condensate.
Figure 4:
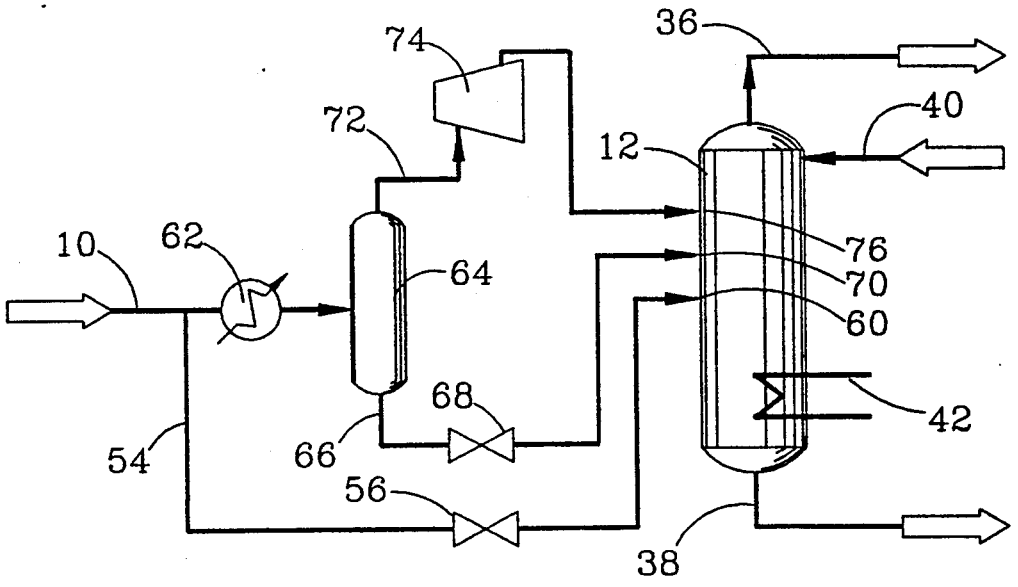
FIG. 4 is a schematic diagram of a further embodiment of the present invention showing a $C_{5+}$ removal column using a split feed stream wherein one portion is cooled and expanded and a reflux comprises LNG.

FIGS. 2–4 illustrate preferred alternative arrangements for the scrub column 12, wherein LNG provides part or all of the reflux, which are particularly attractive when the natural gas composition is lean in $C_{2+}$ components. This arrange is particularly attractive where there are freezable components in the natural gas but relatively low levels of C2–C4 in the natural gas to help scrub out these freezable components. Typical lean natural gas streams comprise (in approximate molar percentages): 94–97% methane, 2–3% ethane, 0.5–1% propane, 0.1–0.2% butane, 0.05–0.1% isobutane, 0.02–0.07% pentane, 0.01–0.05% hexane and 1–3% nitrogen. Because LNG reflux is expensive to produce, allor part of the natural gas feed stream in line 10 is preferably cooler prior to introduction to the column 12 in order to reduce the LNG reflux rate.

As shown in FIG. 2, natural gas is cooled by refrigeration cooler 32 to a temperature from about −40° C. to about 0° C. and introduced to the column 12 at a mid-column feed point 34 (corresponding to a location in the column 12 having similar temperature and composition). The cooler 32 can employ freon or propane as refrigerant although this is not particularly critical to the invention. An overhead vapor product comprising less than about 1 ppm $C_{6+}$ is removed through line 36 to the LNG plant. A bottoms NGL product rich in $C_{6+}$ components, and optionally rich in $C_2$–$C_4$ products, is removed through line 38. The proportion of $C_2$–$C_4$ products in line 38 can be relatively minor or quite substantial, depending on the feed composition and operation of the column 12.

Lighter components are removed from the bottoms in the column 12 by vaporizing liquid accumulated at the bottom of the column. LNG pumped from the LNG plant through line 40 provides reflux for the column 12 to absorb $C_{5+}$ components from the vapor. Temperature at the top of the column is preferably controlled between about −75° C. and about −50° C. by adjusting the rate of the LNG reflux stream. Ordinarily, it should be more economical to operate an overhead vapor condenser; however, an availability of liquid nitrogen having an excess cooling capacity (i.e., nitrogen has a boiling point of −195° C. compared to −182° C. for methane) can reduce the penalty of using LNG reflux to a minimum. This is contrary to the usual case in a multi-component or cascade LNG refrigeration system.

Referring to FIG. 3, lean natural gas is cooled by turbine expander 44 to a temperature between about −10° C. to about −50° C. then introduced to the column 12 at a feed point 46 corresponding to a location in the column 12 having similar temperature and composition as mentioned above. A vapor stream taken from a rectifying section of the column 12 through line 48, is cooled by refrigeration cooler or intercondensers 50, preferably to a temperature of from about −20° C. to about −40° C., and returned to the column through line 52. Liquid condensed from the vapor in line 48 lowers the LNG reflux requirement from line 40. The choice between LNG reflux as opposed to a combined LNG and condensate reflux depends on a determination of lowest energy requirement, i.e. the LNG refrigeration duty versus the refrigerating duty of the cooler 50.

Referring to FIG. 4, lower energy requirements can be achieved in the operation of column 12 when the natural gas feed stream in line 10 is split into several feed substreams, cooled and introduced to the column at different feed points. A first part of the natural gas in line 10 is diverted through a line 54, expanded in a Joule-Thompson expansion through a letdown valve 56 and introduced to the column 12 at a feed point 60. A second portion of the feed stream is cooled by a refrigeration cooler 62 to a temperature as low as −40° C. and introduced to a separator 64. Condensate withdrawn from separator 64 by line 66 is reduced in pressure by letdown valve 68 and introduced to the column 12 at a feed point 70. A remaining vapor portion of the cooled second portion of the feed stream is withdrawn from the separator 64 in line 72, expanded through a turbine expander 74 and introduced to the column 12 at an upper feed point 76. The feed points 60, 70 and 76 generally correspond to the composition and temperature of the respective feed streams. Generally, the feed point 60 is a mid-column feed defining the upper enriching section and the lower stripping section of the column 12. The liquid feed point 70 is generally disposed between the feed point 60 and the vapor feed point 76.

In the practice of the present invention, the LNG reflux can be used alone or proportionally supplemented with condensate present in the feed gas and/or made by cooling vapor withdrawn from the column. The exact proportion of LNG to condensate in the reflux is determined by several considerations including composition of the feed gas, tradeoff of condensate refrigeration duty against LNG liquefaction duty, energy costs against capital costs, type of refrigeration system used in the LNG plant, and the like.

Given lean natural gas streams low in $C_{2+}$ components, or relatively richer natural gas feed where there is already a supply of $C_2$–$C_4$ components for refrigeration, the focus of pretreatment can shift from supplying ethane, propane and butane makeup gas to conventional LNG refrigeration systems to the removal of freezable $C_{5+}$ components. The present invention has several advantages over conventional treatment schemes. In a conventional process, the chilled feed produces liquids which are stripped to remove light components from the bottoms product and heavy components are absorbed near the top of the column by the reflux. In the present invention as illustrated in FIG. 1, the feed temperature is relatively warm and cooling in the column is preferably provided by the overhead condenser. Consequently, the heavy components are absorbed lower in the column to greatly enhance $C_{5+}$ removal efficiency. Shifting column cooling obviates the need for feed chillers which generally operate at a higher pressure than the column necessitating high pressure design criteria. Significantly less ethane is condensed in comparison to the prior art, thus reducing refrigeration and reboiler duty. Other advantages gained by cooling the column at the lower process pressure overhead condenser include greater vapor-liquid density differences for enhanced separation and elimination of any possibility that inlet flow to the pressure letdown valve may be two-phase. The duty of the overhead condenser can ordinarily be satisfied using readily available refrigerants, for example, freon or propane. The prior art typically requires a lower temperature than can be obtained from employing freon or propane necessitating use of multicomponent refrigeration in the column.

The present invention as illustrated in FIGS. 2–4 can employ LNG as the reflux without a significant economic penalty, particularly for LNG plants using liquid nitrogen as refrigerant, in contrast to conventional art. In some cases, liquid nitrogen can be obtained more cheaply than refrigeration generated by cascade or multicomponent systems. However, when operating using LNG as reflux, the column temperature is low and the feed gas must generally be precooled to reduce the LNG reflux.. Use of expanders in the feed stream can generate refrigeration and splitting the feed stream as shown in FIG. 4 can reduce feed cooler and reboiler duty.

EXAMPLE 1 AND COMPARATIVE EXAMPLE 1

A lean natural gas stream comprising 3 mole percent $C_{2+}$, 1 mole percent $N_2$ and 96 mole percent methane is pretreated to remove $C_{5+}$ components using the process of the present invention (Example 1) as shown in FIG. 1. Vapor samples are removed from several mid-column trays and evaluated for $C_6$ concentration. These results are graphically illustrated in FIG. 5. For comparison, a similar feed gas is pretreated using a similar column operating under conventional processing conditions (Comparative Example 1), wherein the inlet feed is cooled, reflux condensate has a lower bubble point temperature (provided by a multicomponent refrigeration system) and the bottoms liquid is distilled by additional columns into ethane, propane and butane products to obtain makeup gas for the multicomponent refrigeration unit. Comparative example vapor samples are also evaluated for $C_6$ concentration as above and are shown graphically in FIG. 5. Operating conditions for both columns are set forth in Table 1.

TABLE 1

| Operating Conditions | Example 1 | Comp. Ex. 1 |
|---|---|---|
| Feed inlet temp (°C.) | 17 | −40 |
| Reflux temp. (°C.) | −40 | −70 |
| Reboiler temp. (°C.) | 27 | 2 |
| No. of trays | 9 | 9 |
| Feed inlet tray | 8 | 4 |
| Average column temp (°C.) | −6 | −34 |
| Column pressure (MPa) | 3.79 | 3.79 |
| Mass ratio V/L products | 18 | 4 |

Figure 5:
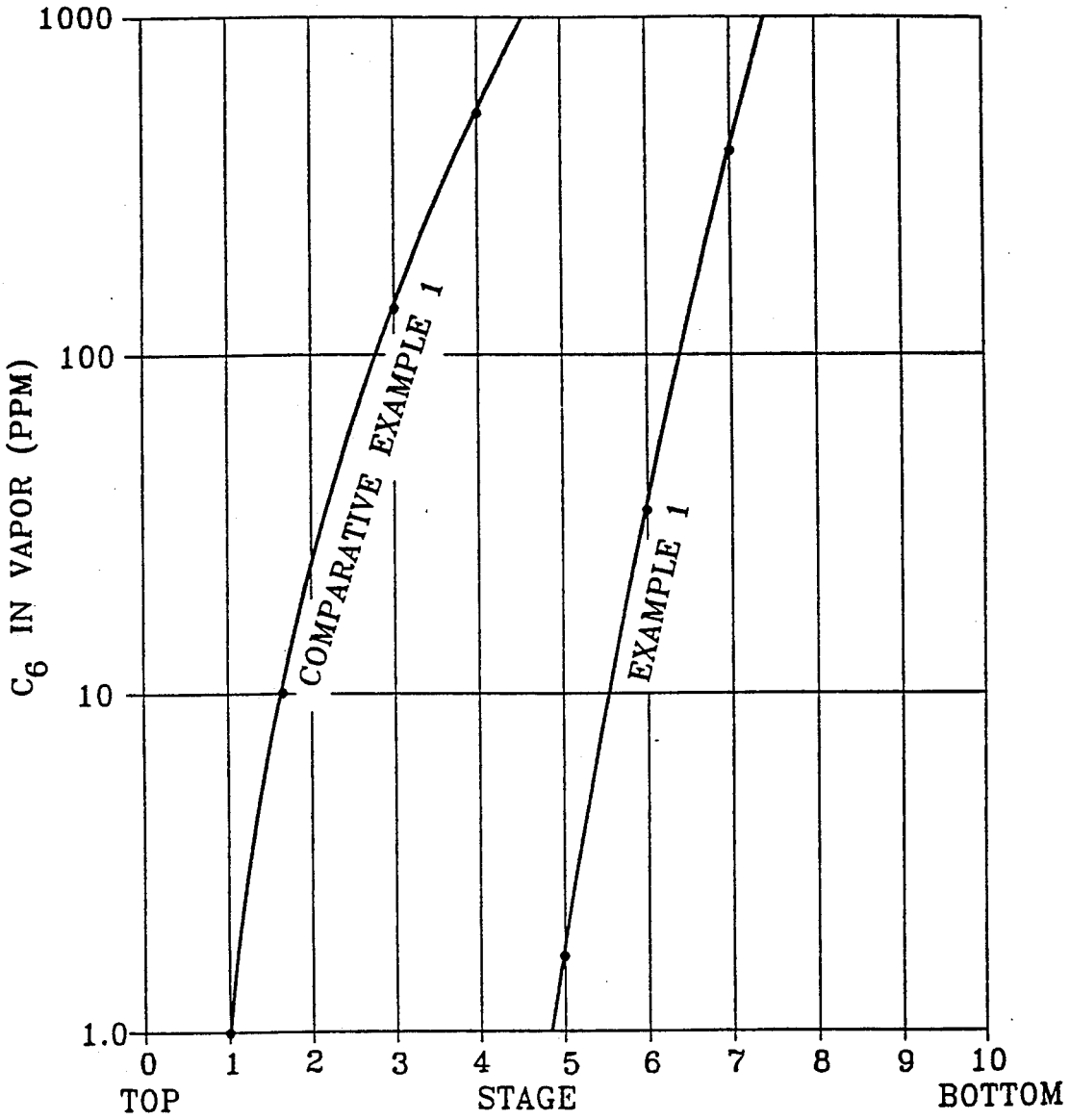
FIG. 5 is a graphical diagram plotting predicted $C_6$ vapor concentration in a scrub column against theoretical stages for both the process of the present invention as shown in FIG. 1 and a typical prior art process (i.e. feed cooling and a relatively higher feed point).

The results shown in FIG. 5 indicate that the process of the present invention results in heavy component removal which is several orders of magnitude better than the conventional processing scheme. The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A method of pretreating a natural gas stream for liquefaction by removing freezable components, comprising the steps of:

introducing a natural gas feed stream to a feed point on a scrub column having upper enriching and lower stripping sections, wherein the feed stream contains methane and $C_{5+}$ hydrocarbons and wherein the feed stream has a $C_2$–$C_4$ vapor to liquid mass ratio above 1.0;

contacting the feed stream with a liquid reflux stream introduced to the upper section of the column to absorb $C_{5+}$ hydrocarbons from the feed stream;

recovering an overhead vapor product containing $C_2$–$C_4$ hydrocarbons and having a concentration of less than about 1 ppm $C_{6+}$ hydrocarbons;

reboiling a portion of liquid in the lower section of the column to strip lighter hydrocarbons from the feed stream;

recovering a liquid bottom product enriched in $C_{5+}$ hydrocarbons; and operating the column to obtain the $C_2$–$C_4$ hydrocarbons primarily in said overhead product.

2. The method of claim 1, wherein the feed stream has a temperature from about 0° C. to about 30° C.

3. The method of claim 1, wherein the number of stages above the feed point to the column is greater than the number of stages below the feed point.

4. The method of claim 1, wherein the reflux stream is at a temperature ranging from about ambient down to about −40° C.

5. The method of claim 1, wherein the reflux stream is essentially free of $C_{5+}$ hydrocarbons.

6. The method of claim 1, further comprising operating an overhead partial condenser to provide the reflux stream.

7. The method of claim 6, further comprising operating from one to three intercondensers positioned between the feed point and the reflux stream.

8. A method of pretreating a lean natural gas stream for liquefaction by removing freezable components, comprising the steps of:

introducing the lean natural gas stream to a first feed point on a scrub column having upper enriching and lower stripping sections, wherein the feed stream contains methane and $C_{5+}$ hydrocarbons;

contacting the feed stream with a liquid reflux stream comprising liquefied natural gas introduced to the upper section of the column to absorb $C_{5+}$ hydrocarbons from the feed stream;

recovering an overhead vapor product having a concentration of less than about 1 ppm $C_{6+}$ hydrocarbons;

reboiling a portion of liquid in the lower section of the scrub column to strip lighter hydrocarbons from the feed stream;

recovering a liquid bottom product enriched in $C_{5+}$ hydrocarbons.

9. The method of claim 8, further comprising condensing at least a portion of the overhead vapor product and refluxing the condensate.

10. The method of claim 8, wherein the condensate reflux stream is at a temperature ranging from about ambient down to about −40° C.

11. The method of claim 8, further comprising the step of expanding the feed stream from a pressure higher than the operating pressure of the column to cool the feed stream prior to the feeding step.

12. The method of claim 8, wherein the natural gas feed stream contains less than about 3 mole percent of $C_{2+}$ hydrocarbons.

13. The method of claim 8, comprising splitting a portion of the feed stream into an upper feed stream, cooling the upper feed stream and introducing the upper feed stream to the column at a second feed point one or more stages above the first feed point.

14. The method of claim 13, comprising separating the cooled upper feed stream into vapor and liquid feed streams, expanding the vapor stream, introducing the expanded vapor feed stream at a second feed point adjacent a top of the column, and introducing the liquid feed stream to a third feed point below the second feed point and one or more stages above the first feed point.

15. The method of claim 8, wherein the temperature at the top of the column is controlled between about −75° C. and about −50° C. by adjusting the rate of the reflux stream.

16. The method of claim 8, wherein the reflux stream is essentially free of $C_{5+}$ hydrocarbons.

17. The method of claim 8, further comprising operating an intercondenser positioned between the feed point and the liquefied natural gas reflux stream.

* * * * *

UNITED STATES PATENT AND TRADEMARK OFFICE

CERTIFICATE OF CORRECTION

PATENT NO. : 5,325,673

DATED : July 5, 1994

INVENTOR(S) : Charles A. Durr, et. al.

It is certified that error appears in the above-indentified patent and that said Letters Patent is hereby corrected as shown below:

On the Title page, item [75], inventor: should read--Charles A. Durr, David A. Coyle, both of Houston; William C. Petterson, Missouri City, all of Tex.

Signed and Sealed this

Eleventh Day of October, 1994

*Attest:*

Bruce Lehman

BRUCE LEHMAN

*Attesting Officer*

*Commissioner of Patents and Trademarks*